US008054258B2

(12) United States Patent
Choi et al.

(10) Patent No.: US 8,054,258 B2
(45) Date of Patent: Nov. 8, 2011

(54) PIXEL, ORGANIC LIGHT EMITTING DISPLAY DEVICE AND DRIVING METHOD THEREOF

(75) Inventors: Sang-moo Choi, Suwon-si (KR); Wang-jo Lee, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 1004 days.

(21) Appl. No.: 11/984,024

(22) Filed: Nov. 13, 2007

(65) Prior Publication Data

US 2008/0111804 A1 May 15, 2008

(30) Foreign Application Priority Data

Nov. 14, 2006 (KR) ..... 10-2006-0112223
Dec. 19, 2006 (KR) ..... 10-2006-0130109

(51) Int. Cl.
*G09G 3/32* (2006.01)

(52) U.S. Cl. ..... 345/82

(58) Field of Classification Search ..... 345/76, 345/82, 85, 206
See application file for complete search history.

(56) References Cited

U.S. PATENT DOCUMENTS

| | | | | |
|---|---|---|---|---|
| 7,310,078 | B2 | 12/2007 | Kim | |
| 7,365,742 | B2 | 4/2008 | Kim et al. | |
| 2005/0099412 | A1 | 5/2005 | Kasai | |
| 2005/0140600 | A1 * | 6/2005 | Kim et al. | 345/76 |
| 2005/0269958 | A1 * | 12/2005 | Choi et al. | 315/169.3 |
| 2005/0275607 | A1 | 12/2005 | Tobita | |
| 2005/0280614 | A1 | 12/2005 | Goh | |
| 2006/0012549 | A1 | 1/2006 | Ikeda | |
| 2006/0066526 | A1 | 3/2006 | Kim et al. | |
| 2006/0066528 | A1 | 3/2006 | Hara | |
| 2006/0152449 | A1 * | 7/2006 | Norimatu | 345/76 |
| 2006/0208971 | A1 * | 9/2006 | Deane | 345/76 |

FOREIGN PATENT DOCUMENTS

| | | | |
|---|---|---|---|
| EP | 1 130 565 | A1 | 9/2001 |
| EP | 1 496 495 | A2 | 1/2005 |
| JP | 2005-189695 | A | 7/2005 |
| JP | 2005-202255 | A | 7/2005 |
| JP | 2006-038963 | A | 2/2006 |
| JP | 2006-053539 | | 2/2006 |
| JP | 2006-146219 | A | 6/2006 |
| JP | 2006-243526 | A | 9/2006 |
| JP | 2006-251632 | A | 9/2006 |
| JP | 2008-039946 | A | 2/2008 |
| KR | 10-2003-0081919 | A | 10/2003 |
| KR | 10-2005-0045814 | | 5/2005 |
| KR | 10-2005-0051300 | A | 6/2005 |
| KR | 10-2005-0098485 | A | 10/2005 |

(Continued)

*Primary Examiner* — Chanh Nguyen
*Assistant Examiner* — Roy Rabindranath
(74) *Attorney, Agent, or Firm* — Lee & Morse, P.C.

(57) ABSTRACT

A pixel includes an organic light emitting diode, a first transistor coupled to a scan line and a data line, the first transistor being configured to receive a data signal via the data line when a scan signal is supplied to the scan line, a storage capacitor configured to store voltage corresponding to the data signal received by the first transistor, a second transistor configured to control an electric current from the first power source to the second power source via the organic light emitting diode with respect to the voltage stored in the storage capacitor, and compensation unit configured to adjust voltage at a gate electrode of the second transistor, the voltage adjustment being sufficient to compensate for a deterioration degree of the organic light emitting diode.

16 Claims, 11 Drawing Sheets

FOREIGN PATENT DOCUMENTS

| | | | |
|---|---|---|---|
| KR | 10-2005-0121379 | | 12/2005 |
| KR | 10-2006-0020502 | | 3/2006 |
| KR | 10-2006-0028021 | A | 3/2006 |
| KR | 10-2006-0029088 | | 4/2006 |
| KR | 10-2006-0046352 | | 5/2006 |
| KR | 10-2006-0048834 | | 5/2006 |
| KR | 10-2006-0054603 | | 5/2006 |
| KR | 10-2006-0071679 | | 6/2006 |
| KR | 10-0623919 | B1 | 9/2006 |
| WO | WO 98/48403 | | 10/1998 |

* cited by examiner

PIXEL, ORGANIC LIGHT EMITTING DISPLAY DEVICE AND DRIVING METHOD THEREOF

BACKGROUND OF THE INVENTION

1. Field of the Invention

Embodiments of the present invention relate to a pixel, an organic light emitting display device including the same, and a driving method thereof. More specifically, embodiments of the present invention relate to a pixel capable of compensating for reduced luminance of a light emitting diode thereof, an organic light emitting display device including the same, and a driving method thereof.

2. Description of the Related Art

In general, flat panel displays, e.g., a liquid crystal display (LCD), a field emission display (FED), a plasma display panel (PDP), an electroluminescent (EL) display, and so forth, may have reduced weight and volume as compared to a cathode ray tube (CRT) display. For example, the EL display, e.g., an organic light emitting display device, may include a plurality of pixels, and each pixel may have a light emitting diode (LED). Each LED may include a light emitting layer emitting red (R), green (G), or blue (B) light triggered by combination of electrons and holes therein, so the pixel may emit a corresponding light to form images. Such an EL display may have rapid response time and low power consumption.

The conventional pixel of the EL display may be driven by a driving circuit configured to receive data and scan signals, and to control light emission from its LED with respect to the data signals. More specifically, an anode of the LED may be coupled to the driving circuit and a first power source, and a cathode of the LED may be coupled to a second power source. Accordingly, the LED may generate light having a predetermined luminance with respect to current flowing therethrough, while the current may be controlled by the driving circuit according to the data signal.

However, the material of the light emitting layer of the conventional LED, e.g., organic material, may deteriorate over time as a result of, e.g., contact with moisture, oxygen, and so forth, thereby reducing current/voltage characteristics of the LED and, consequently, deteriorating luminance of the LED. Further, each conventional LED may deteriorate at a different rate with respect to a composition of its light emitting layer, i.e., type of material used to emit different colors of light, thereby causing non-uniform luminance. Inadequate luminance, i.e., deteriorated and/or non-uniform, of the LEDs may decrease display characteristics of the EL display device, and may reduce its lifespan and efficiency.

SUMMARY OF THE INVENTION

Embodiments of the present invention are therefore directed to a pixel, an organic light emitting display device including the same, and a driving method thereof, which substantially overcome one or more of the problems due to the limitations and disadvantages of the related art.

It is therefore a feature of an embodiment of the present invention to provide a pixel with a compensation unit capable of compensating for inadequate luminance of its light emitting diode (LED).

It is another feature of an embodiment of the present invention to provide an organic light emitting display device with pixels having compensation units capable of compensating for inadequate luminance of their LEDs.

It is yet another of an embodiment of the present invention to provide a driving method of a pixel having a compensation unit capable of compensating for inadequate luminance of its LED.

At least one of the above and other features of the present invention may be realized by providing a pixel, including an organic light emitting diode between first and second power sources, a first transistor coupled to a scan line and a data line, the first transistor being configured to receive a data signal via the data line when a scan signal is supplied to the scan line, a storage capacitor configured to store voltage corresponding to the data signal received by the first transistor, a second transistor coupled to the first transistor and configured to control an electric current from the first power source to the second power source via the organic light emitting diode with respect to the voltage stored in the storage capacitor, and a compensation unit configured to adjust voltage at a gate electrode of the second transistor, the voltage adjustment being sufficient to compensate for a deterioration degree of the organic light emitting diode.

The compensation unit may include a third transistor coupled to an anode electrode of the organic light emitting diode, a fourth transistor between the third transistor and a voltage source, the voltage source having higher voltage than voltage at the anode electrode of the organic light emitting diode, and a feedback capacitor coupled between a gate electrode of the second transistor and a common node of the third and fourth transistors. A voltage at the common node of the third and fourth transistors may substantially equal a voltage at the anode electrode of the organic light emitting diode when the third transistor is turned on, and may substantially equal a voltage at the voltage source when the fourth transistor is turned on. The feedback capacitor may be configured to adjust voltage at the gate electrode of the second transistor to correspond to the voltage at the common node of the third and fourth transistors. The fourth transistor may be configured to be turned off when a first control signal is supplied from a first control line and to be turned on when the supply of the first control signal is suspended, and the third transistor may be configured to be turned on when a second control signal is supplied from a second control line and to be turned off when the supply of the second control signal is suspended. The first and second control signals may have opposite polarities, and each of the first and second control signals may overlap with a scan signal supplied to the scan line.

The fourth transistor may be configured to be turned off when a first control signal is supplied from a first control line, and the third transistor may be configured to be turned on when the first control signal is supplied from the first control line, and the third and fourth transistors have different conductivities. The third transistor may be a NMOS-type transistor. The fourth transistor may be configured to be turned off when a first control signal is supplied from a first control line and to be turned on when the first control signal is suspended, the third transistor may be configured to be turned on when a scan signal is supplied to the scan line, and the first control signal may be overlapping with the scan signal. The fourth transistor may be configured to be turned off when the scan signal is supplied to the scan line, and the third transistor may be configured to be turned on when the scan signal is supplied to the scan lines, and the third and fourth transistors may have different conductivities.

The voltage source may be set to have a lower voltage value than the first power source. The voltage source may be the first power source, an inverted voltage supplied through the scan line, or an inverted voltage supplied through a scan line of an adjacent pixel. A capacity of the feedback capacitor may be configured to correspond to a material of the organic light emitting diode with respect to a color of light emitted from the organic light emitting diode. The pixel may further include a fifth transistor between the second transistor and the organic light emitting diode, the fifth transistor being configured to be turned off when at least the scan signal is supplied. The fifth transistor may be configured to be turned off when a light emitting control signal is supplied to a light emitting control line, and configured to be turned on when the supply of the light emitting control signal is suspended. The light emitting control signal may be overlapping with the scan signal.

At least one of the above and other features of the present invention may be realized by providing an organic light emitting display device, including plurality of pixels coupled to scan lines and data lines, a scan driver configured to supply scan signals via the scan lines, and a data driver configured to drive the data lines, wherein each pixel of the plurality of pixels may include an organic light emitting diode between first and second power sources, a first transistor coupled to a scan line and a data line, the first transistor being configured to receive a data signal via the data line when a scan signal is supplied to the scan line, a storage capacitor configured to store voltage corresponding to the data signal received by the first transistor, a second transistor coupled to the first transistor and configured to control an electric current from the first power source to the second power source via the organic light emitting diode with respect to the voltage stored in the storage capacitor, and a compensation unit configured to adjust voltage at a gate electrode of the second transistor, the voltage adjustment being sufficient to compensate for a deterioration degree of the organic light emitting diode.

At least one of the above and other features of the present invention may be realized by providing a method for driving an organic light emitting display device, the method including receiving a data signal in a first transistor via a data line when a scan signal is supplied to a scan line, storing a voltage corresponding to the data signal in a storage capacitor, the storage capacitor being coupled to a gate electrode of a second transistor, adjusting voltage at a first terminal of a feedback capacitor to a voltage at an anode electrode of an organic light emitting diode, the feedback capacitor having a second terminal coupled to the gate electrode of the second transistor, and suspending the scan signal, so the voltage at the first terminal of the feedback capacitor is increased to a voltage level of a voltage source.

The second transistor may controls a current capacity from a first power source to a second power source via the organic light emitting diode with respect to voltage at the gate electrode of the second transistor. The voltage level the voltage source may be higher voltage than the voltage at the anode electrode of the organic light emitting diode, and may be lower than voltage of the first power source. Increasing voltage at the first terminal of the feedback capacitor may include electrically disconnecting the second transistor and the organic light emitting diode during supply of the scan signal. Voltage at the anode electrode of the organic light emitting diode may be a threshold voltage of the organic light emitting diode.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
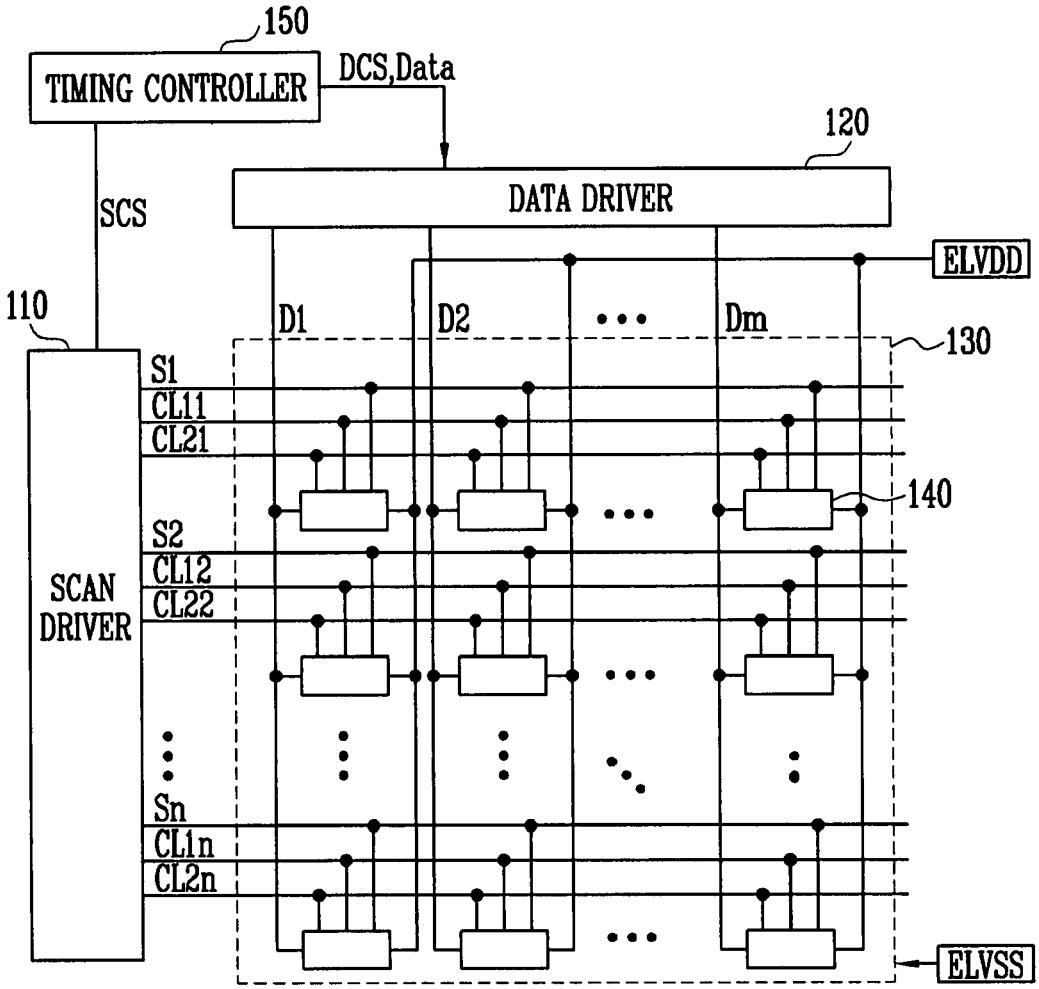
FIG. 1 illustrates a schematic diagram of an organic light emitting display device according to an embodiment of the present invention.

Korean Patent Application Nos. 10-2006-0112223, filed on Nov. 14, 2006 and 10-2006-0130109, filed on Dec. 19, 2006, in the Korean Intellectual Property Office, and entitled: "Pixel, Organic Light Emitting Display Device and Driving Method Thereof," are incorporated by reference herein in their entirety.

Embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of elements and regions may be exaggerated for clarity of illustration. It will also be understood that when an element is referred to as being "on" another element, it can be directly on the other layer or substrate, or intervening layers may also be present. Further, it will also be understood that when an element is referred to as being "between" two elements, it can be the only element between the two elements, or one or more intervening elements may also be present. In addition, when an element is referred to as being "coupled to" another element, it can be directly connected to another element or be indirectly connected to another element with one or more intervening elements interposed therebetween. Like reference numerals refer to like elements throughout.

Referring to FIG. 1, an organic light emitting display device according to an embodiment of the present invention may include a pixel unit 130 having a plurality of pixels 140, a scan driver 110 to drive scan lines (S1 to Sn), first control lines (CL11 to CL1*n*), and second control lines (CL21 to C2*n*), a data driver 120 to drive data lines (D1 to Dm), and a timing controller 150 for controlling the scan driver 110 and the data driver 120. The pixels 140 of the pixel unit 130 may be arranged in any suitable pattern, so each pixel 140 may be coupled to a scan line (S1 to Sn), a first control line (CL11 to CL1*n*), a second control line (CL21 to C2*n*), and/or a data line (D1 to Dm), as illustrated in FIG. 1.

Figure 4:
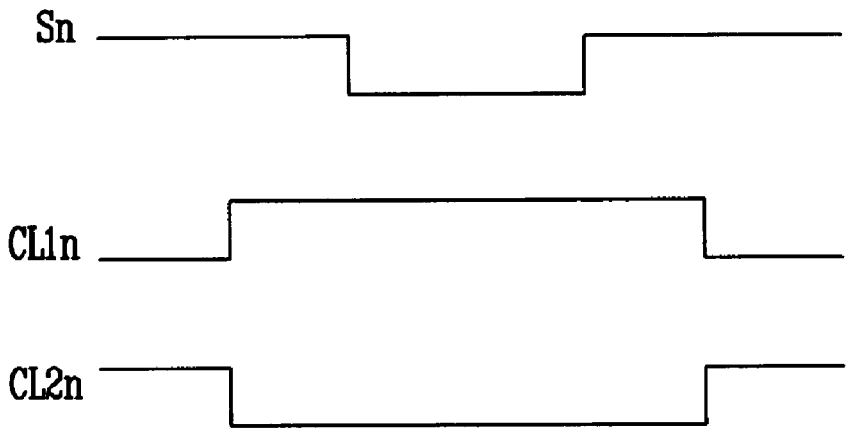
FIG. 4 illustrates a waveform diagram of signals in the circuit diagram of FIG. 2.
Figure 14:
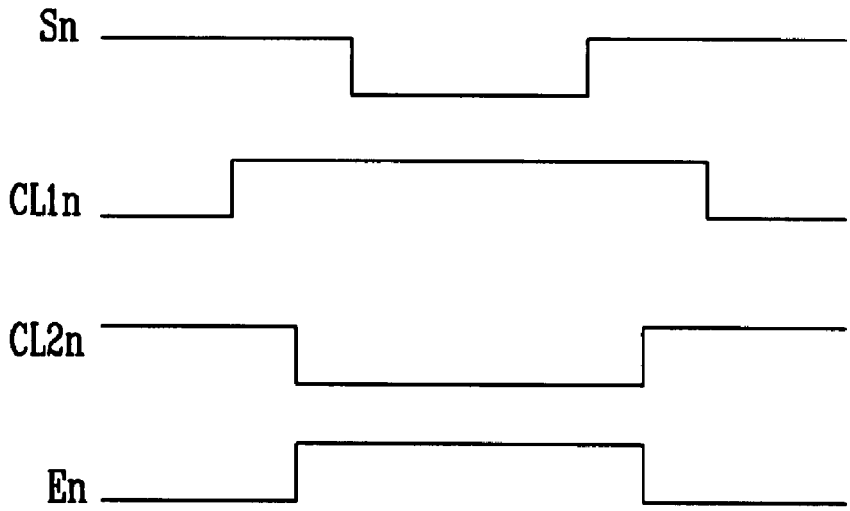
FIG. 14 illustrates a waveform diagram of signals in the circuit diagram of FIG. 12.

The scan driver 110 of the organic light emitting display device may receive a scan drive control signal (SCS) from the timing controller 150, and may generate a corresponding scan signal to be supplied to the scan lines (S1 to Sn). Also, the scan driver 110 may generate first and second control signals in response to the received SCS, and may supply the generated first and second control signals to the first and second control lines (CL11 to CL1*n*) and (CL21 to CL2*n*), respectively. The first and second control signals may have substantially same lengths, and may be opposite to one another. The scan signal may be shorter than and completely overlap with each of its corresponding first and second control signals, as will be described in more detail below with respect to FIG. 4. In this respect, it is noted that a length of a signal hereinafter may refer to a width of a single pulse along a horizontal axis, as illustrated in FIGS. 4 and 14. It is further noted an "overlap" as related to signals refers hereinafter to an overlap with respect to time.

The data driver 120 of the organic light emitting display device may receive a data drive control signal (DCS) from the timing controller 150, and may generate a corresponding data signal to be supplied to the data lines (D1 to Dm).

The timing controller 150 of the organic light emitting display device may generate synchronized (DCS) and (SCS) signals to be supplied to the data driver 120 and the scan driver 110, respectively. Additionally, the timing controller 150 may transmit data information from an external source to the data driver 120.

The pixel unit 130 may be coupled to a first power source (ELVDD) and to a second power source (ELVSS), so voltage of each of the first and second power sources (ELVDD) and (ELVSS) may be supplied to each of the pixels 140. Accordingly, each of the pixels 140 receiving voltage from the first and second power sources (ELVDD) and (ELVSS) may generate light in accordance with the data signal supplied thereto. A compensation unit 142 may be installed in each of the pixels 140 to compensate for a deterioration degree of the organic light emitting diode, as will be described in more detail below with respect to FIGS. 2-3. In this respect it is noted that "deterioration degree" refers to a measure of a reduced amount of voltage at the anode of the organic light emitting diode in which a substantially high level of total current has passed, as compared to an amount of voltage at an anode of an organic light emitting diode in which a substantially low level of total current has passed.

Figure 2:
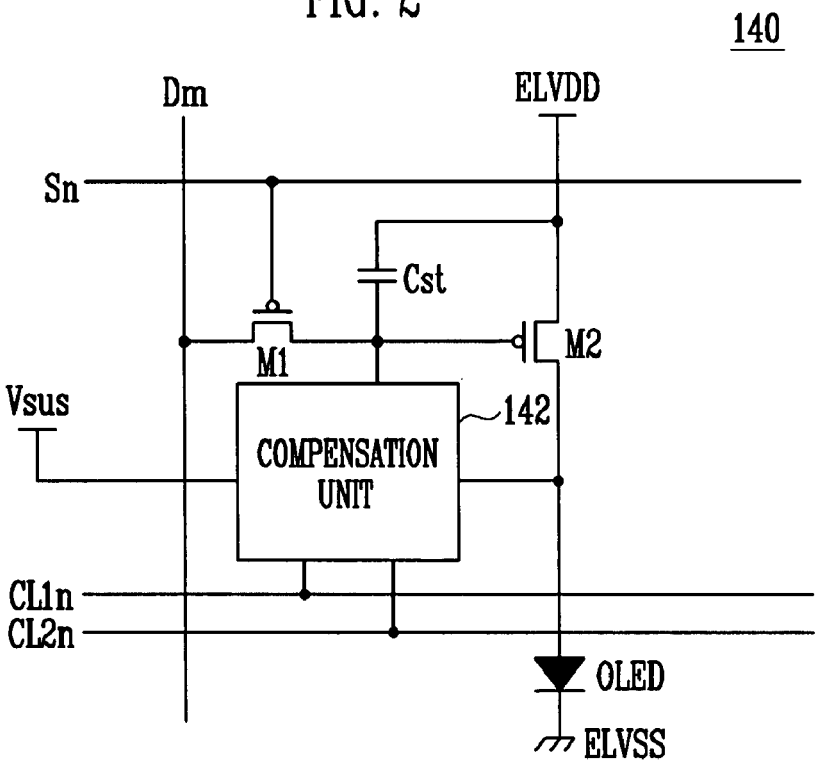
FIG. 2 illustrates a circuit diagram of a pixel in the organic light emitting display device of FIG. 1 according to an embodiment of the present invention.

Referring to FIG. 2, each pixel 140 may include an organic light emitting diode (OLED) and a driving circuit capable of controlling current supplied to the OLED, so light emitted by the OLED may correspond to a data signal supplied to the pixel 140. The driving circuit may include a first transistor (M1), a second transistor (M2), a storage capacitor (Cst), and a compensation unit 142. An anode electrode of the OLED may be coupled to the second transistor (M2), and a cathode electrode of the OLED may be coupled to the second power source (ELVSS), so the OLED may generate a predetermined luminance with respect to the electric current supplied by the second transistor (M2). The second transistor (M2) may be referred to as a driving transistor.

The first transistor (M1) may have its gate electrode coupled to the scan line (Sn), and may have its first and second electrodes coupled to the data line (Dm) and gate electrode of the second transistor (M2), respectively. The first transistor (M1) may be turned on when a scan signal is supplied to its gate electrode, so a data signal may be supplied through the data line (Dm) to the second electrode of the first transistor (M1) to be transmitted through the first electrode of the first transistor (M1) to the gate electrode of the second transistor (M2). In this respect, it is noted that a first electrode of a transistor refers to either one of the source and/or drain thereof, so a second electrode of a transistor refers to a corresponding drain and/or source thereof. In other words, if a first electrode is a source, the second electrode is a drain, and vice versa.

The second transistor (M2) may have its gate electrode coupled to a second electrode of the first transistor (M1), and may have its first and second electrodes coupled to the first power source (ELVDD) and the anode electrode of the OLED, respectively. The second transistor (M2) may receive the data signal from the first transistor (M1), and may control current flowing from the first power source (ELVDD) to the second power source (ELVSS) via the OLED to correspond to the data signal received from the first transistor (M1). In other words, the OLED may generate light in accordance with a voltage at the gate electrode of the second transistor (M2). Voltage of the first power source (ELVDD) may be set to be higher than voltage of the second power source (ELVSS).

The storage capacitor (Cst) may be coupled between the gate electrode of the second transistor (M2) and the first power source (ELVDD), so the storage capacitor (Cst) may store voltage corresponding to the data signal transmitted from the first transistor (M1) to the second transistor (M2).

The compensation unit 142 may be coupled to the gate electrode of the second transistor (M2) to adjust voltage thereof upon deterioration of the OLED. More specifically, the compensation unit 142 may be coupled to a voltage source (Vsus), a first control line (CL1*n*), and a second control line (CL2*n*), so the voltage source (Vsus) may be used to adjust the voltage at the gate electrode of the second transistor (M2) with respect to signals received from the first and second control lines (CL1*n*) and (CL2*n*), as will be discussed in more detail below with respect to FIG. 3. Accordingly, a voltage of the voltage source (Vsus) may be higher than a voltage (Voled), i.e., voltage at the anode electrode of the OLED and corresponding to an electric current flowing through the OLED, but may be lower than the first power source (ELVDD) in order to generate sufficient luminance in the pixel 140. In this respect it is noted that Referring to FIG. 3, the compensation unit 142 may include a third transistor (M3) and a fourth transistor (M4) arranged between the voltage source (Vsus) and an anode electrode of the OLED, and a feedback capacitor (Cfb) between a first node (N1) and a gate electrode of the second transistor (M2). The first node N1 may be a common node of the third and fourth transistors (M3) and (M4), so the feedback capacitor (Cfb) may account for a change in voltage between the first node (N1) and the second transistor (M2).

Figure 3:
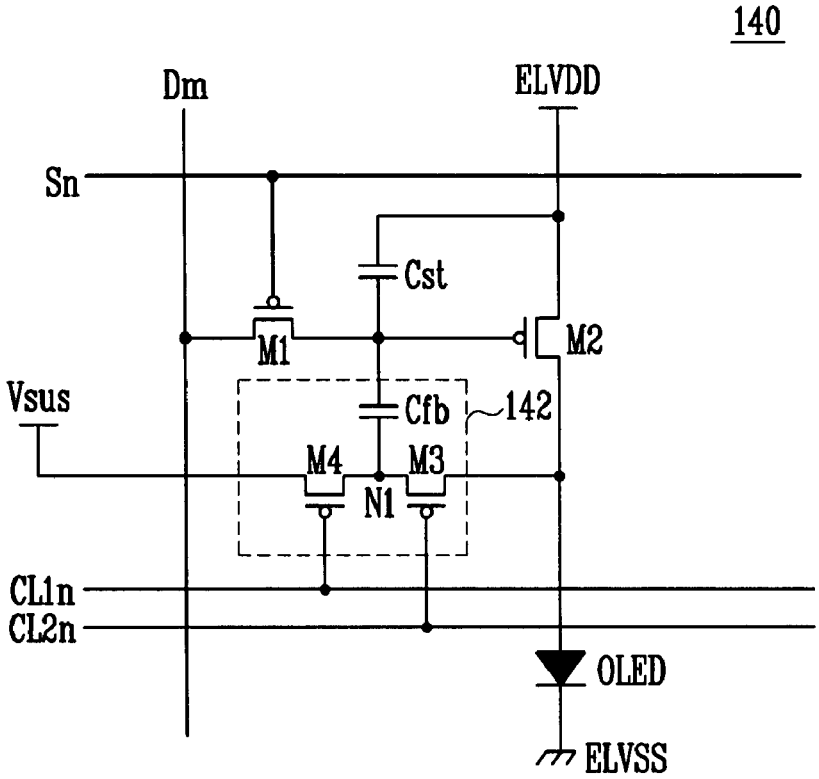
FIG. 3 illustrates a detailed circuit diagram of a compensation unit in the pixel of FIG. 2 according to an embodiment of the present invention.

As illustrated in FIGS. 3-4, the third transistor (M3) may be between the first node (N1) and the anode electrode of the OLED, and may be controlled by a second control signal, e.g., a low voltage signal, supplied by the second control line (CL2*n*). The fourth transistor (M4) may be between the first node (N1) and the voltage source (Vsus), and may be controlled by a first control signal, e.g., a high voltage signal, supplied by the first control line (CL1*n*). The first and second control signals may be supplied to the gate electrodes of the fourth and third transistors (M4) and (M3), respectively, before a scan signal is supplied to the scan line (Sn), so the fourth transistor (M4) may be turned off and the third transistor (M3) may be turned on. When the fourth transistor (M4) is turned off and the third transistor (M3) is turned on, the voltage (Voled) may be supplied to the first node (N1).

Once the voltage (Voled) is supplied to the first node (N1), the scan signal may be supplied via the scan line (Sn) to the first transistor (M1) to turn on the first transistor (M1). Once the first transistor (M1) is turned on, voltage corresponding to the data signal supplied via the data line (Dm) may be stored in the storage capacitor (Cst), followed by suspension of the scan signal. In other words, once voltage is stored in the storage capacitor (Cst), the first transistor (M1) may be turned off.

After the first transistor (M1) is turned off, the first and second control signals may be suspended, as further illustrated in FIG. 4, so the fourth transistor (M4) may be turned on and the third transistor (M3) may be turned off. If the fourth transistor (M4) is turned on, the voltage at the first node (N1) may increase from (Voled) to the voltage of the voltage source (Vsus). Once the voltage at the first node (N1) is increased, voltage at the gate electrode of the second transistor (M2) may increase. In particular, the increased voltage value at the gate electrode of the second transistor (M2) may be determined according to the relationship illustrated in Equation 1 below, $$\Delta V_{M2_gate} = \Delta V_{N1} \times (\mathrm{Cfb}/(\mathrm{Cst}+\mathrm{Cfb})) \qquad \text{Equation 1}$$

where $\Delta V_{M2_gate}$ represents the change in the voltage of the gate electrode of the second transistor (M2), and $\Delta V_{N1}$ represents the change in the voltage of the first node (N1).

As can be seen in Equation 1, voltage at the gate electrode of the second transistor (M2) may vary with respect to the change in the voltage at the first node (N1). Accordingly, when voltage at the first node (N1) is increased to correspond to the voltage of the voltage source (Vsus), voltage at the gate electrode of the second transistor (M2) may also increase according to Equation 1 above. The increased voltage at the gate electrode of the second transistor (M2) may increase the electric current, i.e., from the first power source (ELVDD) to the second power source (ELVSS), via the OLED in order to maintain a predetermined luminance thereof. In other words, the OLED may be configured to generate light having a predetermined luminance corresponding to the voltage at the gate electrode of the second transistor (M2). Accordingly, the current capacity of the second transistor (M2) may correspond to the data signal, i.e., voltage stored in the storage capacitor (Cst), and may be adjusted to a higher value when the OLED is deteriorated, so the luminance generated by the OLED may be constant regardless of its deterioration degree.

For example, when the OLED deteriorates, voltage (Voled) therethrough may decrease, thereby lowering voltage at the first node (N1) and, consequently, lowering the voltage at the gate electrode of the second transistor (M2). However, setting the voltage source (Vsus) with respect to a deterioration degree of the OLED may compensate for the reduced value of the voltage (Voled) by increasing the voltage at the gate electrode of the second transistor (M2). The increased voltage of the gate electrode of the second transistor (M2) may increase the current capacity of the second transistor (M2), thereby compensating for reduced luminance caused by the OLED deterioration. Accordingly, the voltage source (Vsus) may be set to a value corresponding to a voltage value reflecting the deterioration degree of the OLED, so the voltage source (Vsus) may provide sufficient compensation to a deteriorated OLED.

Additionally, each pixel 140 may be set to have a feedback capacitor (Cfb) having a capacity corresponding to a color emitted by its respective OLED. In other words, each OLED of a pixel 140 may include a different light emitting material with a different relative lifespan length corresponding to a specific composition of its light emitting layer, i.e., material emitting green (G), red (R), or blue (B) lights. Since pixels emitting G, R, and B light, as illustrated in Equation 2 below, may have different lifespans, adjusting capacity of the of feedback capacitors (Cfb) with respect to specific materials to impart a substantially uniform deterioration rate to all the pixels 140 may provide substantially uniform lifespan characteristics to all the pixels 140.

$$(B\ \mathrm{Pixels})_{LifeSpan} < (R\ \mathrm{Pixels})_{LifeSpan} < (G\ \mathrm{Pixels})_{LifeSpan} \qquad \text{Equation 2}$$

For example, since B Pixels may have a shorter lifespan, as compared to the R and/or G Pixels, the capacity of the feedback capacitor (Cfb) in each B Pixel may be set to have a higher capacity value, as compared to the feedback capacitors (Cfb) of the R and/or G Pixels. The capacity of the feedback capacitor (Cfb) in each pixel 140 may be determined according to a material used in the corresponding light emitting layer of the OLED, so non-uniform deterioration of multiple OLEDs of pixels 140 emitting different light colors may be compensated for.

Figure 5:
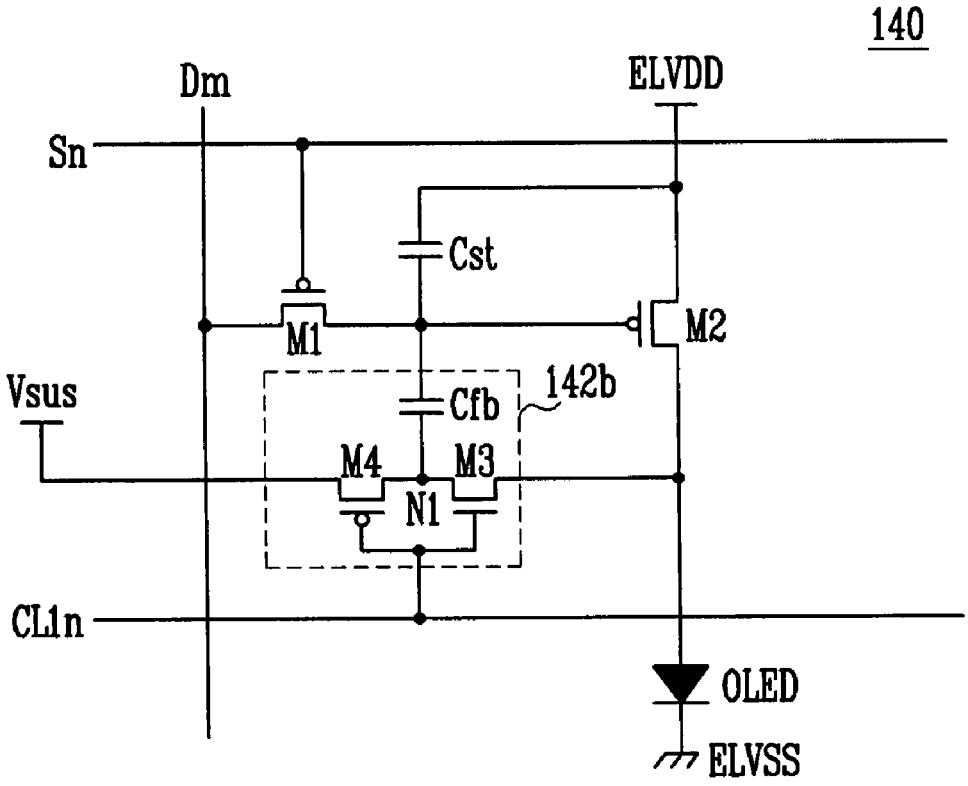
FIG. 5 illustrates a detailed circuit diagram of a compensation unit in the pixel in FIG. 2 according to another embodiment of the present invention.

According to another embodiment illustrated FIG. 5, a compensation unit 142*b* may be substantially similar to the compensation unit 142 described previously with respect to FIG. 3 with the exception of being coupled to a single control line. More specifically, the compensation unit 142*b* may include the feedback capacitor (Cfb) and the third and fourth transistors (M3) and (M4) in a substantially same configuration described previously with respect to FIG. 3, with the exception of having the first control line CL1*n* coupled to both the third and fourth transistors (M3) and (M4). Accordingly, the first control line CL1*n* may control both the third and fourth transistors (M3) and (M4).

More specifically, the third transistor (M3) may have an opposite conductivity as compared to the first, second, and fourth transistors (M1), (M2), and (M4). For example, as illustrated in FIG. 5, the third and fourth transistors (M3) and (M4) may be NMOS-type and PMOS-type transistors, respectively. Accordingly, a first control signal supplied to the first control line (CL1*n*) may turn on the third transistor (M3) and turn off the fourth transistor (M4). Similarly, when supply of the first control signal to the first control line (CL1n) is suspended, operational states of the third and fourth transistors (M3) and (M4) may be reversed, i.e., the third transistor (M3) may be turned off and the fourth transistor (M4) may be turned on. The compensation unit 142*b* illustrated in FIG. 5 may be advantageous in providing a circuit driven by a single control line, i.e., the second control line (CL2*n*) illustrated in FIG. 3, may be removed.

Operation of the compensation unit 142*b* may be substantially similar to operation of the compensation unit 142 described previously with respect to FIG. 4, and may be illustrated with reference to FIG. 4. More specifically, a first control signal may be supplied to the first control line (CL1*n*) before a scan signal is supplied to the scan line (Sn), thereby turning off the fourth transistor (M4) and turning on the third transistor (M3). When the third transistor (M3) is turned on, the voltage (Voled) of the OLED may be supplied to the first node (N1).

Then, the scan signal may be supplied to the scan line (Sn), thereby turning on the first transistor (M1). When the first transistor (M1) is turned on, the voltage corresponding to the data signal supplied to the data line (Dm) may be stored in the storage capacitor (Cst), followed by suspension of the scan signal, thereby turning off the first transistor (M1). Once the first transistor (M1) is turned off, the first control signal to the first control line (CL1*n*) may be suspended, thereby turning off the third transistor (M3) and turning on the fourth transistor (M4). When the fourth transistor (M4) is turned on, the voltage at the first node (N1) may increase to the voltage of the voltage source (Vsus), so the voltage of the gate electrode of the second transistor (M2) may also increase. The increase of voltage at the first node (N1) and the second transistor (M2) may be adjusted to compensate for deterioration of the OLED, thereby minimizing decrease of luminance thereof.

Figure 6:
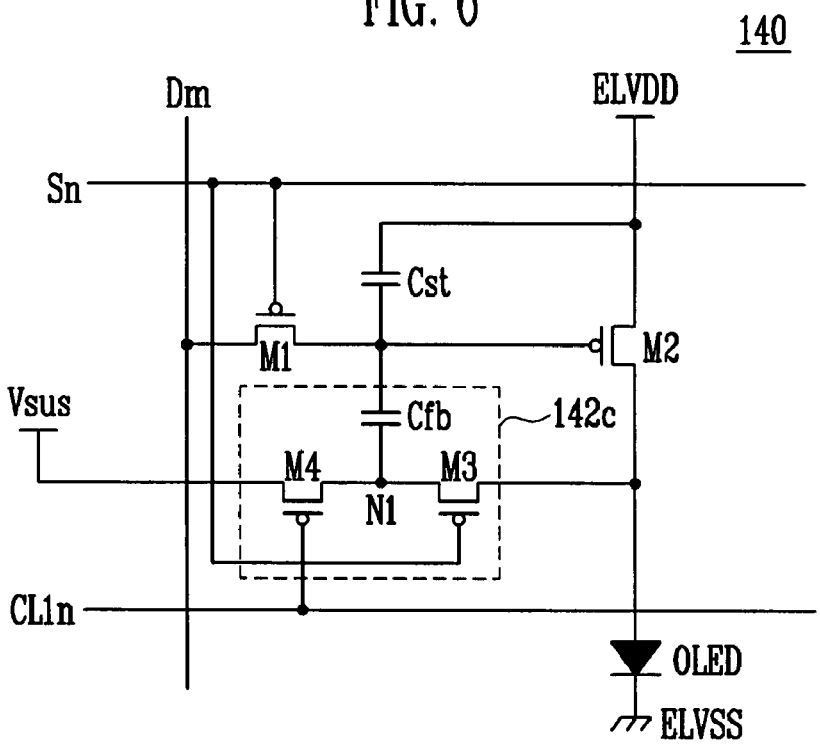
FIG. 6 illustrates a detailed circuit diagram of a compensation unit in the pixel in FIG. 2 according to another embodiment of the present invention.

According to another embodiment illustrated FIG. 6, a compensation unit 142*c* may be substantially similar to the compensation unit 142 described previously with respect to FIG. 3, with the exception of being coupled to a single control line and the scan line (Sn). More specifically, the compensation unit 142*c* may include the feedback capacitor (Cfb) and the third and fourth transistors (M3) and (M4) in a substantially same configuration described previously with respect to FIG. 3, with the exception of having the third transistor (M3) coupled to the scan line (Sn), as opposed to being coupled to the second control line (CL2*n*). Accordingly, the third transistor (M3) may be controlled by a scan signal supplied from the scan line (Sn), and the fourth transistor (M4) may be controlled by the first control signal supplied from the first control line (CL1*n*). The compensation unit 142*c* illustrated in FIG. 6 may be advantageous in providing a circuit driven by a single control line, i.e., the second control line (CL2*n*) illustrated in FIG. 3 may be removed.

Operation of the compensation unit 142*c* may be substantially similar to operation of the compensation unit 142 described previously with respect to FIG. 3, and may be illustrated with reference to FIG. 4. More specifically, a first control signal, i.e., a high signal, may be supplied to the first control line (CL1*n*) to turn the fourth transistor (M4) off. The first control signal may be supplied before a scan signal is supplied to the scan line (Sn).

While the first control signal is supplied to the first control line (CL1*n*), a scan signal to the scan line (Sn) may be initiated, so the first and third transistors (M1) and (M3) may be turned on. When the first transistor (M1) is turned on, the data signal (Dm) may be transmitted through the first transistor (M1), and may be stored in the storage capacitor (Cst). Simultaneously, since the third transistor (M3) is turned on, the voltage (Voled) of the OLED may be supplied to the first node (N1). Once voltage corresponding to the data signal is stored in the storage capacitor (Cst), and voltage (Voled) is supplied to the first node (N1), the scan signal may be suspended, so the first and third transistors (M1) and (M3) may be turned off.

After the first transistor (M1) and the third transistor (M3) are turned off, the supply of the first control signal to the first control line (CL1*n*) may be suspended to turn off the fourth transistor (M4). Once the fourth transistor (M4) is turned off, voltage at the first node (N1) may increase to a voltage of the voltage source (Vsus), thereby triggering voltage increase at the gate electrode of the second transistor (M2) according to Equation 1. Accordingly, it is possible to compensate for deterioration of the OLED by adjusting the voltage increase at the gate electrode of the second transistor (M2).

Figure 7:
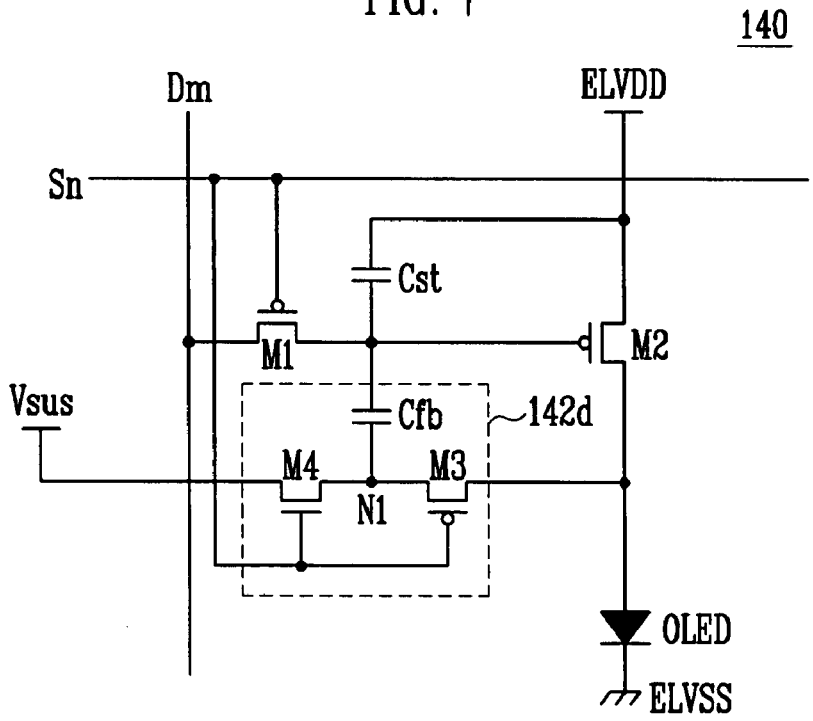
FIG. 7 a detailed circuit diagram of a compensation unit in the pixel in FIG. 2 according to another embodiment of the present invention.

According to another embodiment illustrated in FIG. 7, a compensation unit 142*d* may be substantially similar to the compensation unit 142 described previously with respect to FIG. 3, with the exception of being coupled to the scan line (Sn), as opposed to being coupled to first and second control lines (CL1*n*) and (CL2*n*). More specifically, the compensation unit 142*d* may include the feedback capacitor (Cfb) and the third and fourth transistors (M3) and (M4) in a substantially same configuration described previously with respect to FIG. 3, with the exception that both the third and fourth transistors (M3) and (M4) may be coupled to and controlled by the scan line (Sn).

More specifically, the fourth transistor (M4) may have an opposite conductivity as compared to the first, second, and third transistors (M1), (M2), and (M3). For example, as illustrated in FIG. 7, the third and fourth transistors (M3) and (M4) may be PMOS-type and NMOS-type transistors, respectively. Accordingly, the fourth transistor (M4) may be turned off when a scan signal is supplied to the scan line (Sn), and may be turned on when the scan signal is not supplied to the scan line (Sn). Operation of the third transistor (M3) may be opposite to operation of the fourth transistor with respect to the scan signal. The compensation unit 142*d* illustrated in FIG. 7 may be advantageous in providing a circuit driven by the scan line (Sn), so the first control line (CL1*n*) and the second control line (CL2*n*) may be removed.

Operation of the compensation unit 142*d* will be described in detail below. First, a scan signal may be supplied to the scan line (Sn), so the first and third transistors (M1) and (M3) may be turned on, while the fourth transistor (M4) may be turned off. Accordingly, voltage corresponding to the data signal supplied to the data line (Dm) may be stored in the storage capacitor (Cst), and voltage (Voled) may be supplied to the first node (N1). Next, the scan signal may be suspended.

Once supply of the scan signal is suspended, the first and third transistors (M1) and (M3) may be turned off, and the fourth transistor (M4) may be turned on. Subsequently, voltage at the first node (N1) may increase to voltage of the voltage source (Vsus), thereby triggering voltage increase at the gate electrode of the second transistor (M2) according to Equation 1. Accordingly, it is possible to compensate for deterioration of the OLED by adjusting the voltage increase at the gate electrode of the second transistor (M2).

It is noted that even though embodiments illustrated in FIGS. 3-7 included the voltage source (Vsus) as a voltage source coupled to the fourth transistor (M4), other voltage sources for the fourth transistor (M4), e.g., embodiments described with respect to FIGS. 8-10 below, are within the scope of the present invention. Accordingly, each of the embodiments illustrated in FIGS. 3-7 may be configured to include coupling of the fourth transistor (M4) to a voltage source other than the voltage source (Vsus).

Figure 8:
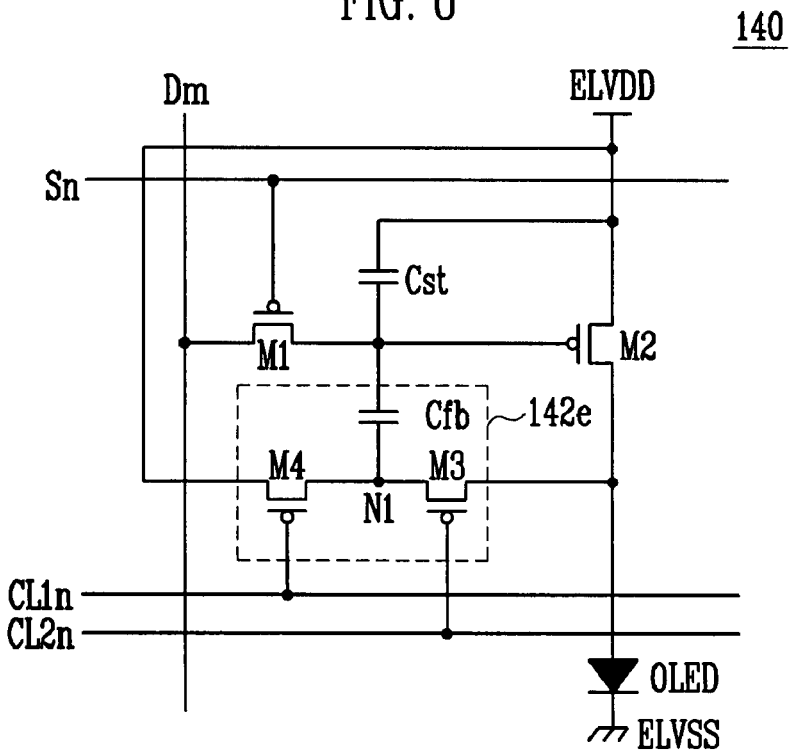
FIG. 8 illustrates a detailed circuit diagram of a compensation unit in the pixel in FIG. 2 according to another embodiment of the present invention.

For example, according to another embodiment illustrated in FIG. 8, a compensation unit 142*e* may be substantially similar to the compensation unit 142 described previously with respect to FIG. 3, with the exception of having the fourth transistor (M4) coupled to the first power source (ELVDD), as opposed to being coupled to the voltage source (Vsus). Accordingly, voltage at the first node (N1) may be increased from the voltage (Voled) to voltage of the first power source (ELVDD), so voltage at the gate electrode of the second transistor (M2) may be increased with respect to Equation 1 to compensate for deterioration of the OLED even when the fourth transistor (M4) is not coupled to the voltage source (Vsus).

Figure 9:
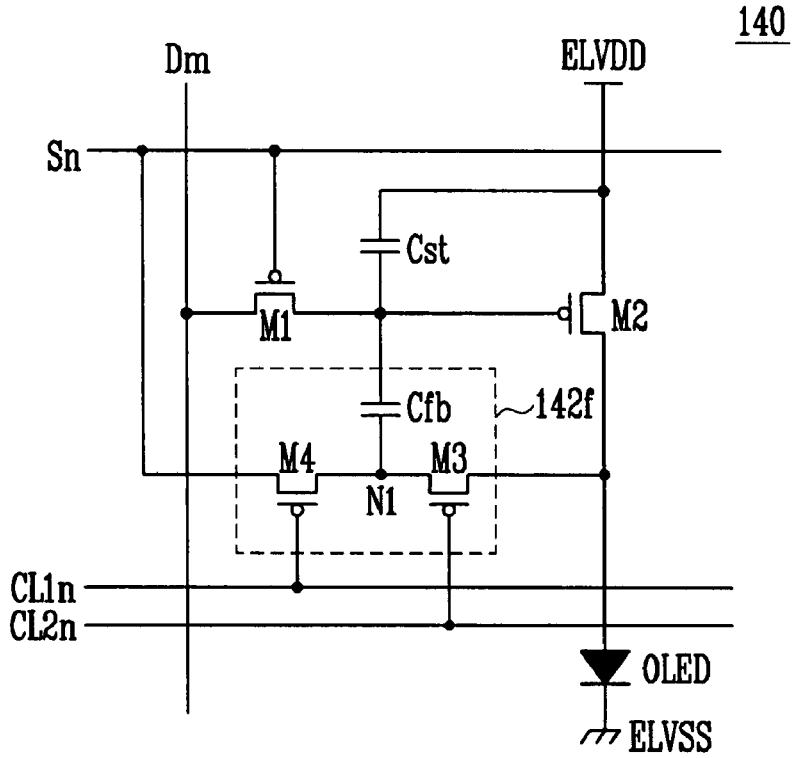
FIG. 9 illustrates a detailed circuit diagram of a compensation unit in the pixel in FIG. 2 according to another embodiment of the present invention.

According to another embodiment illustrated FIG. 9, a compensation unit 142*f* may be substantially similar to the compensation unit 142 described previously with respect to FIG. 3, with the exception of having the fourth transistor (M4) coupled to the scan line (Sn), as opposed to being coupled to the voltage source (Vsus). More specifically, the compensation unit 142*f* may include the feedback capacitor (Cfb) and the third and fourth transistors (M3) and (M4) in a substantially same configuration described previously with respect to FIG. 3, with the exception of using voltage corresponding to the scan signal, i.e., an inverted voltage signal, in the scan line (Sn) when the fourth transistor (M4) is turned on, as illustrated in FIGS. 4 and 9. Accordingly, voltage at the first node (N1) may be increased from the voltage (Voled) to voltage of the scan line (Sn), so deterioration of the OLED may be stably compensated for. In this respect, it is noted that voltage of the scan lines in the organic light emitting display device (Sn) may be set to be higher than voltage Voled.

Figure 10:
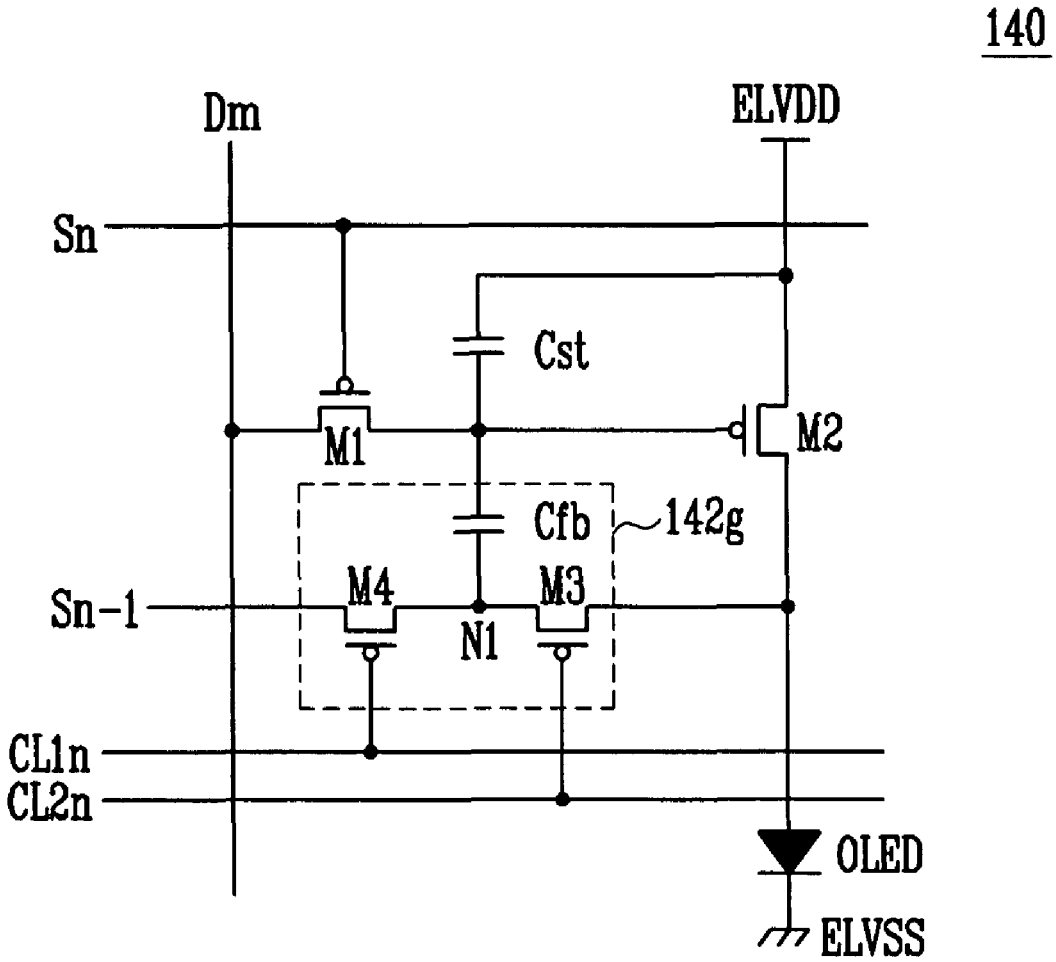
FIG. 10 illustrates a detailed circuit diagram of a compensation unit in the pixel in FIG. 2 according to another embodiment of the present invention.

According to another embodiment illustrated FIG. 10, a compensation unit 142*g* may be substantially similar to the compensation unit 142 described previously with respect to FIG. 3 with the exception of having the fourth transistor (M4) coupled to a previous scan line (Sn−1), i.e., a scan line of an adjacent pixel, as opposed to being coupled to the voltage source (Vsus). More specifically, the compensation unit 142*g* may include the feedback capacitor (Cfb) and the third and fourth transistors (M3) and (M4) in a substantially same configuration described previously with respect to FIG. 3, with the exception of using voltage corresponding to the scan signal, i.e., an inverted voltage signal, in the previous scan line (Sn−1) when the fourth transistor (M4) is turned on, as illustrated in FIGS. 4 and 10. Accordingly, voltage at the first node (N1) may be increased from the voltage (Voled) to voltage of the previous scan line (Sn−1), so deterioration of the OLED may be stably compensated for.

Figure 11:
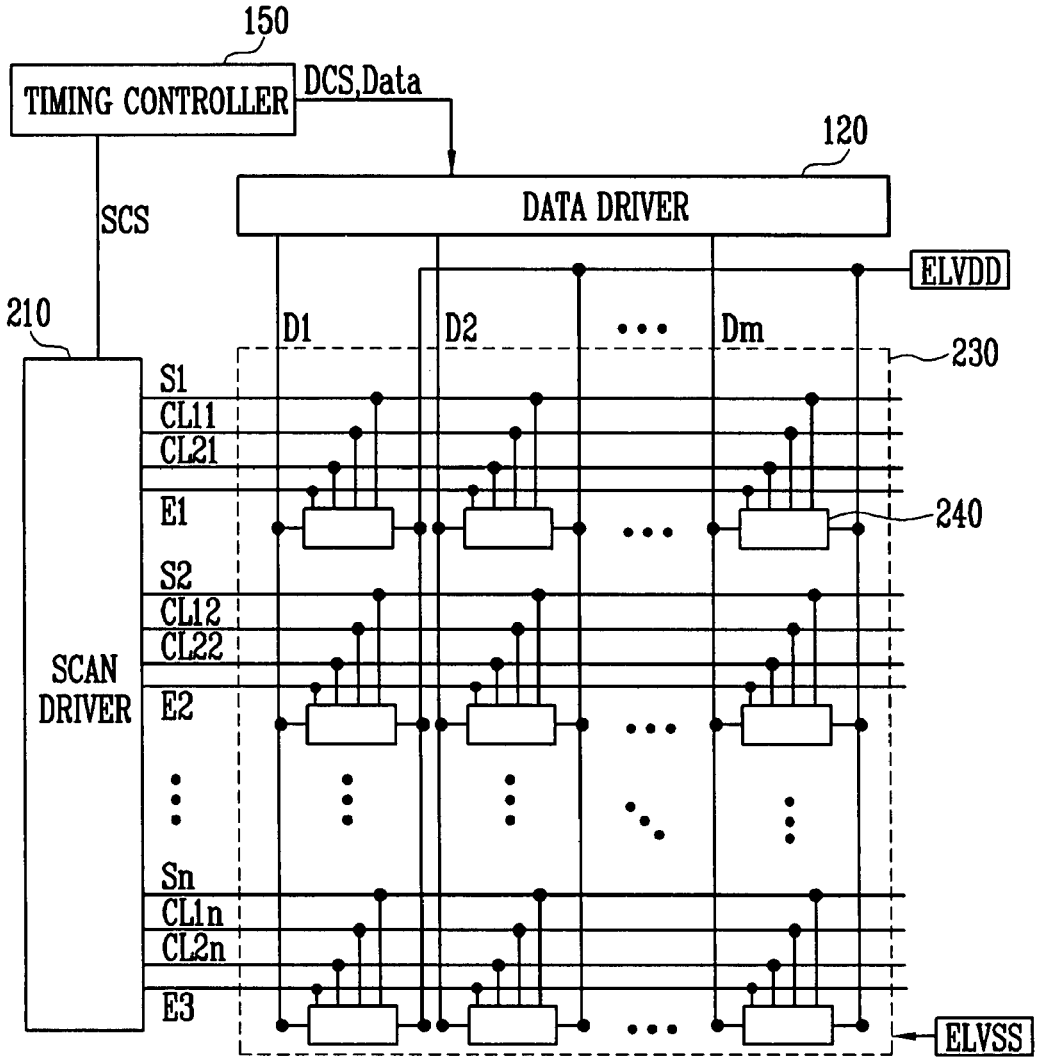
FIG. 11 illustrates a schematic diagram of an organic light emitting display device according to another embodiment of the present invention.

According to another embodiment illustrated FIG. 11, an organic light emitting display device may be substantially similar to the organic light emitting display device described previously with reference to FIG. 1, with the exception of including a plurality of pixels 240 in a pixel unit 230, and light emitting control lines (E1 to En) in addition to the scan lines (S1 to Sn), the first control lines (CL11 to CL1*n*), the second control lines (CL21 to C2*n*), and the data lines (D1 to Dm), as illustrated in FIG. 11. Accordingly, a scan driver 210 of the organic light emitting display device may generate a light emitting control signal to supply to the light emitting control lines (E1 to En).

The light emitting control signal may have a substantially same length as the second control signal, and may be opposite thereto, as illustrated in FIG. 14. The light emitting control signal may be longer than the scan signal, and may be shorter than the first control signal, as further illustrated in FIG. 14. The light emitting control signal, the scan signal, the first control signal, and the second control signal may overlap with one another.

Figure 12:
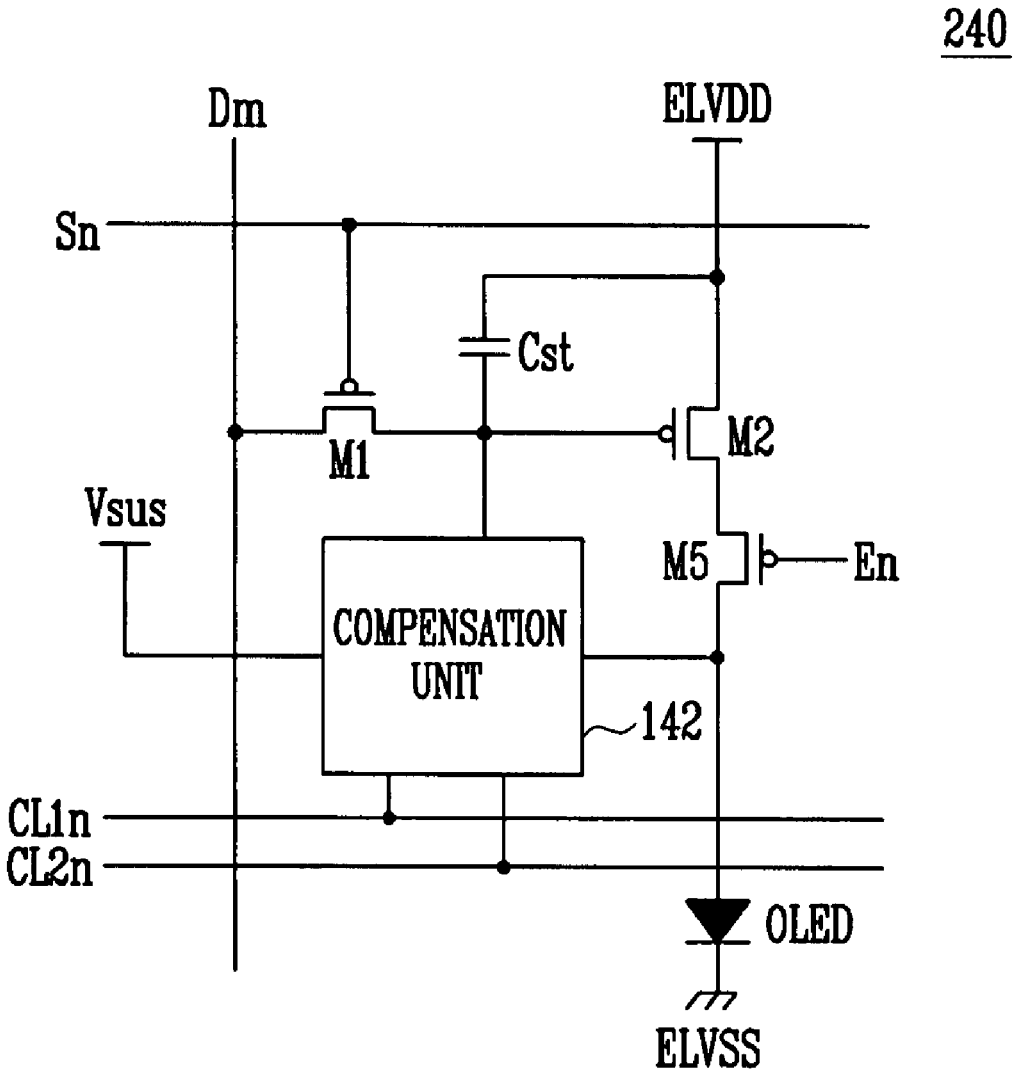
FIG. 12 illustrates a circuit diagram of a pixel in the organic light emitting display device of FIG. 11 according to an embodiment of the present invention.

Referring to FIG. 12, each pixel 240 may include an organic light emitting diode (OLED) and a driving circuit capable of controlling current supplied to the OLED, so light emitted by the OLED may correspond to a data signal supplied to the pixel 140. The driving circuit may be substantially similar to the driving circuit of the pixel 140 described previously with respect to FIG. 2, with the exception of including a fifth transistor (M5) between the OLED and the second transistor (M2), so the light emitting control signal may be input into the gate electrode of the fifth transistor (M5). The fifth transistor (M5) may be turned off when a light emitting control signal is supplied thereto, and may be turned on when the light emitting control signal is not supplied.

More specifically, an anode electrode of the OLED may be coupled to the fifth transistor (M5), and a cathode electrode of the OLED may be coupled to the second power source (ELVSS), so the OLED may generate light with the predetermined luminance with respect to the electric current supplied by the second transistor (M2) via the fifth transistor (M5). The first transistor (M1), storage capacitor (Cst), and compensation unit 142 may be arranged in a substantially similar configuration as described previously with respect to FIG. 2, and therefore, their detailed description will not be repeated herein. The second transistor (M2) may be configured in a substantially similar way as described previously with respect to FIG. 2, with the exception of having its second electrode coupled to a first electrode of the fifth transistor (M5).

Figure 13:
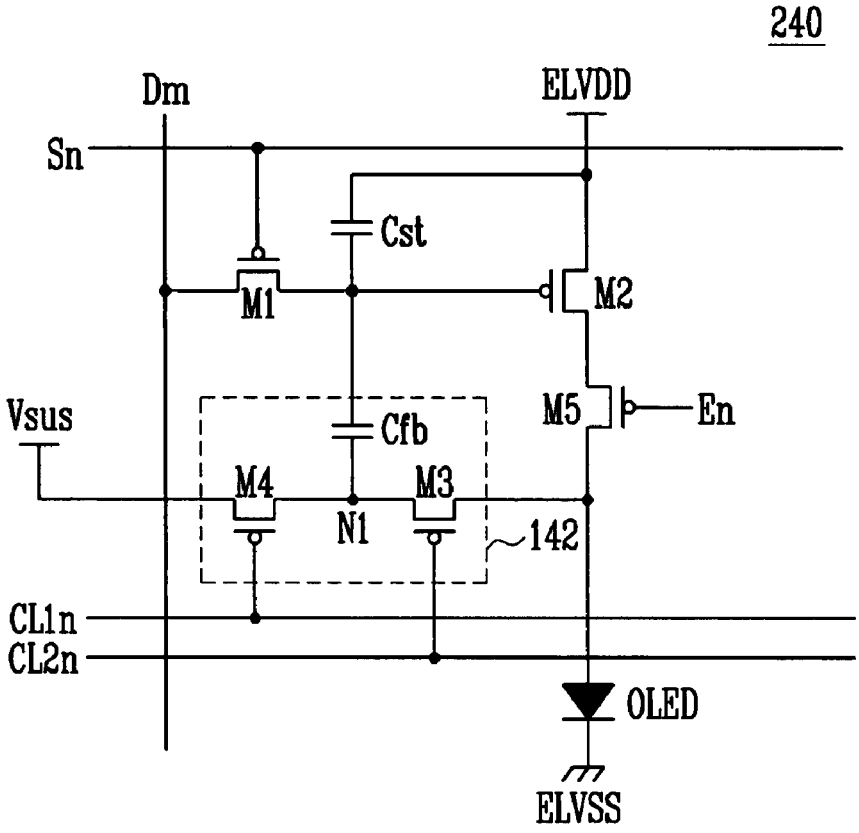
FIG. 13 illustrates a detailed circuit diagram of a compensation unit in the pixel of FIG. 12 according to an embodiment of the present invention.

Referring to FIG. 13, the pixel 240 may be substantially similar to the pixel a40 described previously with reference to FIG. 3, with the exception of including the fifth transistor (M5) to substantially minimize and/or prevent unnecessary electric current flow into the OLED.

Referring to FIGS. 13-14, operation of the pixel 240 may be as follows. First, a first control signal, i.e., a high voltage pulse, may be supplied to the first control line (CL1*n*), so the fourth transistor (M4) may be turned off. Accordingly, the first node (N1) and the voltage source (Vsus) may be electrically disconnected, i.e., when the fourth transistor (M4) is turned off.

Once the fourth transistor (M4) is turned off, a second control signal, i.e., a low voltage pulse, may be supplied to the second control line (CL2*n*), so the third transistor (M3) may be turned on. Simultaneously, a light emitting control signal, i.e., a high voltage pulse, may be supplied to the light emitting control line (En), so the fifth transistor (M5) may be turned off. Once the third transistor (M3) is turned on, the voltage (Voled) of the OLED may be supplied to the first node (N1). In this respect, it is noted that since the fifth transistor (M5) is turned off, the voltage (Voled) may be set to a threshold voltage of the OLED.

Next, the scan signal may be supplied to the scan line (Sn), so the first transistor (M1) may be turned on. When the first transistor (M1) is turned on, voltage corresponding to the data signal supplied to the data line (Dm) may be transmitted through the first transistor (M1), and may be stored in the storage capacitor (Cst). Once the data signal is stored, the first transistor (M1) may be turned off by suspending the scan signal.

Next, supplies of the second control signal and the light emitting control signal may be suspended, so the third transistor may be turned off and the fifth transistor (M5) may be turned on, respectively. Then, the first control signal may be suspended to turn on the fourth transistor (M4). When the fourth transistor (M4) is turned on, the voltage at the first node (N1) may be increased to a voltage of the voltage source (Vsus), thereby triggering an increase in a voltage of the gate electrode of the second transistor (M2). The voltage at the gate electrode of the second transistor (M2) may be calculated according to Equation 1.

Accordingly, when the OLED deteriorates, the voltage (Voled), which reflects a deterioration degree of the OLED, may be decreased, thereby lowering voltage at the first node (N1) and, consequently, lowering the voltage at the gate electrode of the second transistor (M2). However, according to embodiments of the present invention, setting the voltage source (Vsus) to increase the voltage at the first node (N1) and, consequently, increasing the voltage at the gate electrode of the second transistor (M2), may increase a current capacity of the second transistor (M2) in order to correspond to the same data signal. In other words, the current capacity of the second transistor (M2) may be increased as a degree of deterioration of the OLED increases, so reduced luminance caused by the deterioration of the OLED may be compensated. In this respect, it is noted that the compensation unit 142 may be configured according to any configurations described previously with respect to FIGS. 5-10.

Figure 15:
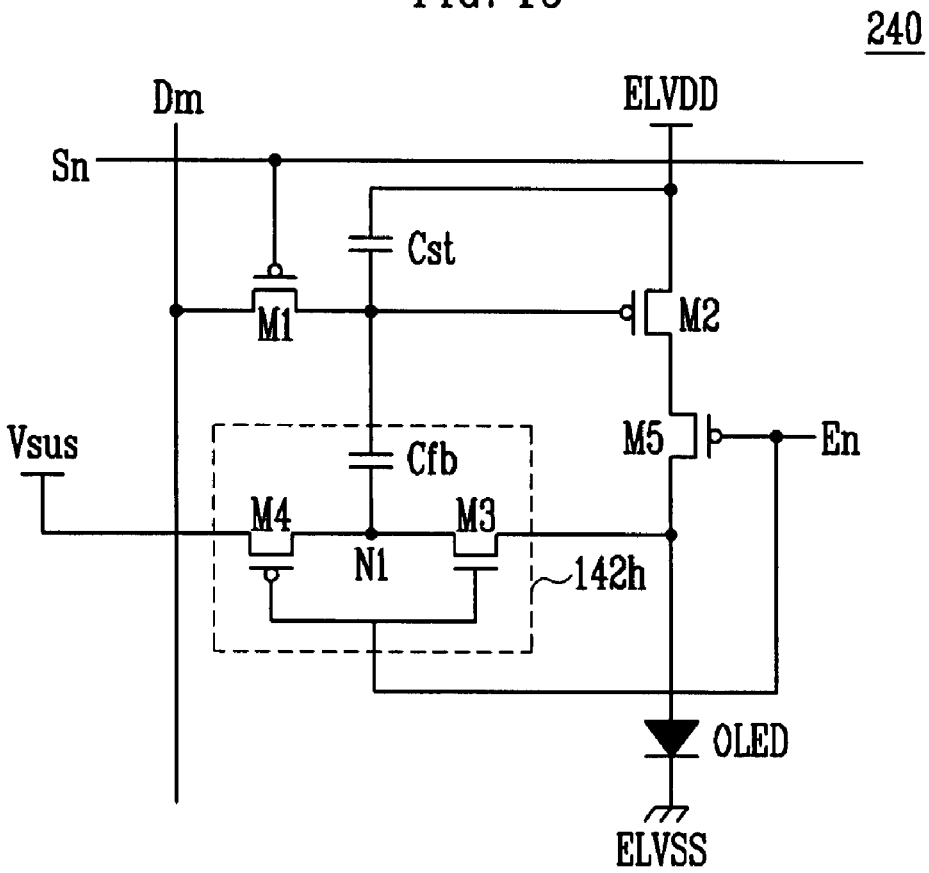
FIG. 15 illustrates a detailed circuit diagram of a compensation unit in the pixel in FIG. 12 according to another embodiment of the present invention.

According to another embodiment illustrated in FIG. 15, a compensation unit 142*h* may be substantially similar to the compensation unit 142 described previously with respect to FIG. 13, with the exception of being coupled to the light emitting control line (En), as opposed to being coupled to the first and second control lines (CL1) and (CL2). More specifically, the compensation unit 142*h* may include the feedback capacitor (Cfb) and the third and fourth transistors (M3) and (M4) in a substantially same configuration described previously with respect to FIG. 13, with the exception of having both the third and fourth transistors (M3) and (M4) coupled to and controlled by a light emitting control signal supplied from the light emitting control line (En).

More specifically, the third transistor (M3) may have an opposite conductivity as compared to the first, second, fourth, and fifth transistors (M1), (M2), (M4), and (M5). For example, as illustrated in FIG. 15, the third and fourth transistors (M3) and (M4) may be NMOS-type and PMOS-type transistors, respectively. Accordingly, a light emitting control signal supplied to the light emitting control line (En) may turn on the third transistor (M3), and may turn off the fourth transistor (M4). Similarly, when supply of light emitting control signal supplied from the light emitting control line (En) is suspended, operational states of the third and fourth transistors (M3) and (M4) may be reversed, i.e., the third transistor (M3) may be turned off, and the fourth transistor (M4) may be turned on. The compensation unit 142*h* illustrated in FIG. 15 may be advantageous in removing the first and second control lines (CL1*n*) and (CL2*n*).

Operation of the compensation unit 142*h* may be substantially similar to operation of the compensation unit 142 described previously with respect to FIGS. 13-14, and may be illustrated with reference to FIG. 14. First, a light emitting control signal may be supplied to the light emitting control line (En) before a scan signal is supplied to the scan line (Sn). Accordingly, the fourth and fifth transistors (M4) and (M5) may be turned off, and the third transistor (M3) may be turned on. When the third transistor (M3) is turned on, voltage (Voled) of the OLED may be supplied to the first node (N1).

Then, a scan signal may be supplied to the scan line (Sn) to turn on the first transistor (M1). When the first transistor (M1) is turned on, the voltage corresponding to the data signal supplied to the data line (Dm) may be stored in the storage capacitor (Cst), followed by suspension of the scan signal, so the first transistor (M1) may be turned off. Once the first transistor (M1) is turned off, the supply of the light emitting control signal may be suspended, thereby turning on the fourth and fifth transistors (M4) and (M5). When the fourth transistor (M4) is turned on, the voltage at the first node (N1) may increase to a voltage of the voltage source (Vsus), so the voltage of the gate electrode of the second transistor (M2) may be increased. Accordingly, deterioration of the OLED may be compensated by adjusting an increase in voltage at the gate electrode of the second transistor (M2) to correspond to the deterioration of the OLED.

Figure 16:
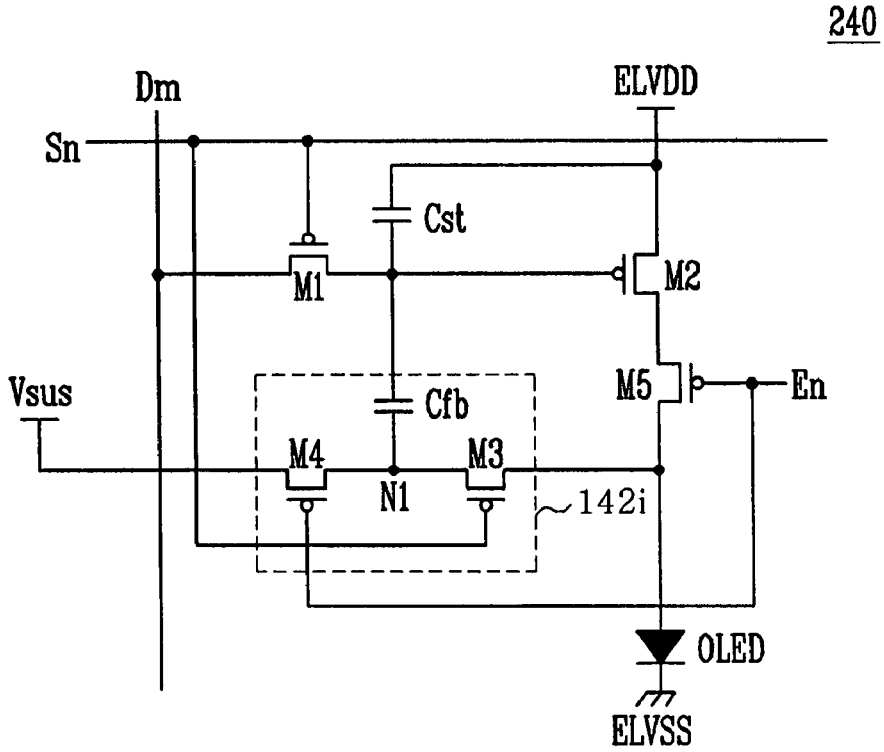
FIG. 16 illustrates a detailed circuit diagram of a compensation unit in the pixel in FIG. 12 according to another embodiment of the present invention.

According to another embodiment illustrated in FIG. 16, a compensation unit 142*i* may be substantially similar to the compensation unit 142 described previously with respect to FIG. 13, with the exception of being coupled to the light emitting control line (En) and scan line (Sn), as opposed to being coupled to the first and second control lines (CL1) and (CL2). More specifically, the compensation unit 142*i* may include the feedback capacitor (Cfb) and the third and fourth transistors (M3) and (M4) in a substantially same configuration described previously with respect to FIG. 13, with the exception of having the third and fourth transistors (M3) and (M4) coupled to and controlled by the scan line (Sn) and the light emitting control line (En), respectively. The compensation unit 142*i* illustrated in FIG. 16 may be advantageous in removing the first and second control lines (CL1*n*) and (CL2*n*).

Operation of the compensation unit 142*i* may be substantially similar to operation of the compensation unit 142 described previously with respect to FIGS. 13-14, and may be illustrated with reference to FIG. 14. First, a light emitting control signal may be supplied to the light emitting control line (En) before a scan signal is supplied to the scan line (Sn). Accordingly, the fourth and fifth transistors (M4) and (M5) may be turned off.

Then, a scan signal may be supplied to the scan line (Sn) to turn on the first and third transistors (M1) and (M3). When the first transistor (M1) is turned on, the voltage corresponding to the data signal supplied to the data line (Dm) may be stored in the storage capacitor (Cst), and when the third transistor (M3) is turned on, voltage (Voled) of the OLED may be supplied to the first node (N1). After voltage corresponding to the data signal is stored in the storage capacitor (Cst), the first transistor (M1) and the third transistor (M3) may be turned off by suspension of the scan signal. Once the first and third transistors (M1) and (M3) are turned off, the supply of the light emitting control signal may be suspended, thereby turning on the fourth and fifth transistors (M4) and (M5). When the fourth transistor (M4) is turned on, the voltage at the first node (N1) may increase to a voltage of the voltage source (Vsus), so the voltage of the gate electrode of the second transistor (M2) may be increased. Accordingly, deterioration of the OLED may be compensated by adjusting an increase in voltage at gate electrode of the second transistor (M2) to correspond to the deterioration of the OLED.

Figure 17:
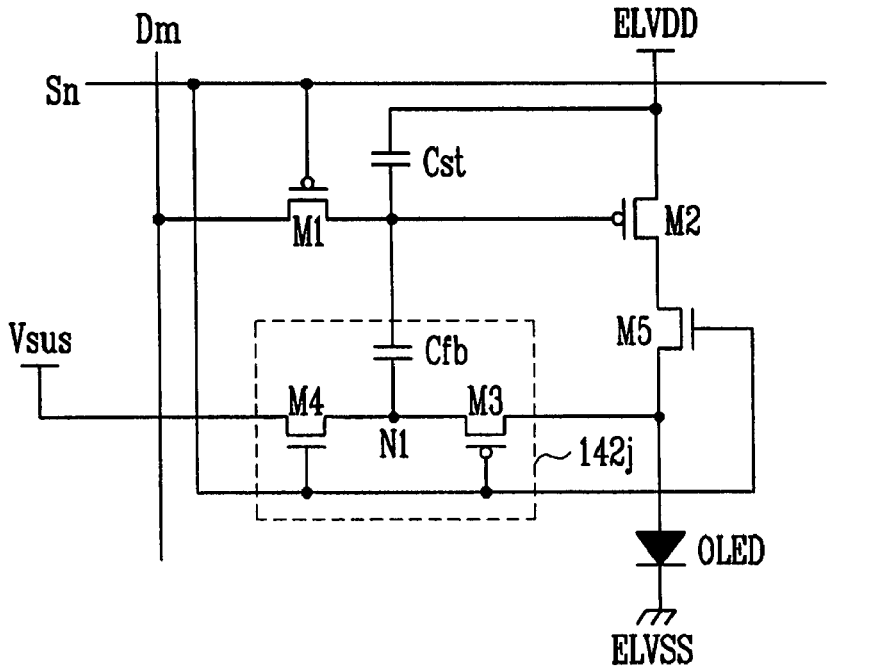
FIG. 17 illustrates a detailed circuit diagram of a compensation unit in the pixel in FIG. 12 according to another embodiment of the present invention.

According to another embodiment illustrated in FIG. 17, a compensation unit 142*j* may be substantially similar to the compensation unit 142 described previously with respect to FIG. 13, with the exception of being coupled to the scan line (Sn), as opposed to being coupled to the first and second control lines (CL1) and (CL2). More specifically, the compensation unit 142*j* may include the feedback capacitor (Cfb) and the third and fourth transistors (M3) and (M4) in a substantially same configuration described previously with respect to FIG. 13, with the exception of having the third, fourth, and fifth transistors (M3), (M4), and (M5) coupled to and controlled by a scan signal supplied by the scan line (Sn).

More specifically, the fourth and fifth transistors (M4) and (M5) may have opposite conductivities as compared to the first, second, and third transistors (M1), (M2), and (M3). For example, as illustrated in FIG. 17, the fourth and fifth transistors (M4) and (M5) may be NMOS-type transistors. Accordingly, a scan signal supplied to the scan line (Sn) may turn off the fourth and fifth transistors (M4) and (M5), and may turn on the third transistor (M3), and vice versa. The compensation unit 142*j* illustrated in FIG. 17 may be advantageous in removing the first and second control lines (CL1*n*) and (CL2*n*), and the light emitting control line (En).

Operation of the compensation unit 142*j* may be substantially similar to operation of the compensation unit 142 described previously with respect to FIGS. 13-14, and may be illustrated with reference to FIG. 14. First, a scan signal may be supplied to the scan line (Sn) to turn on the first and third transistors (M1) and (M3), and to turn off the fourth and fifth transistor (M4) and (M5). When the first transistor (M1) is turned on, the voltage corresponding to the data signal supplied to the data line (Dm) may be stored in the storage capacitor (Cst). When the third transistor (M3) is turned on, the voltage (Voled) of the OLED may be supplied to the first node (N1). After voltage corresponding to the data signal is stored in the storage capacitor (Cst) and, simultaneously, the voltage (Voled) of the OLED is supplied to the first node (N1), the supply of the scan signal may suspended to turn off the first and third transistors (M1) and (M3), and to turn on the fourth and fifth transistors (M4) and (M5). When the fourth transistor (M4) is turned on, the voltage at the first node (N1) may increase to a voltage of the voltage source (Vsus), so the voltage of the gate electrode of the second transistor (M2) may be increased. Accordingly, deterioration of the OLED may be compensated by adjusting an increase in voltage at gate electrode of the second transistor (M2) to correspond to the deterioration of the OLED.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A pixel, comprising:

an organic light emitting diode between first and second power sources;

a first transistor coupled to a scan line and a data line, the first transistor being configured to receive a data signal via the data line when a scan signal is supplied to the scan line;

a storage capacitor configured to store voltage corresponding to the data signal received by the first transistor;

a second transistor coupled to the first transistor and configured to control an electric current from the first power source to the second power source via the organic light emitting diode with respect to the voltage stored in the storage capacitor; and a compensation unit configured to adjust voltage at a gate electrode of the second transistor, the voltage adjustment being sufficient to compensate for a deterioration degree of the organic light emitting diode, wherein the compensation unit includes:

a third transistor coupled to an anode electrode of the organic light emitting diode;

a fourth transistor between the third transistor and a voltage source, the voltage source having higher voltage than voltage at the anode electrode of the organic light emitting diode; and a feedback capacitor coupled between a gate electrode of the second transistor and a common node of the third and fourth transistors.

2. The pixel as claimed in claim 1, wherein a voltage at the common node of the third and fourth transistors substantially equals a voltage at the anode electrode of the organic light emitting diode when the third transistor is turned on, and substantially equals a voltage at the voltage source when the fourth transistor is turned on.

3. The pixel as claimed in claim 2, wherein the feedback capacitor is configured to adjust voltage at the gate electrode of the second transistor to correspond to the voltage at the common node of the third and fourth transistors.

4. The pixel as claimed in claim 2, wherein the fourth transistor is configured to be turned off when a first control signal is supplied from a first control line and to be turned on when the supply of the first control signal is suspended, and the third transistor is configured to be turned on when a second control signal is supplied from a second control line and to be turned off when the supply of the second control signal is suspended.

5. The pixel as claimed in claim 4, wherein the first and second control signals have opposite polarities, and each of the first and second control signals overlaps with a scan signal supplied to the scan line.

6. The pixel as claimed in claim 2, wherein the fourth transistor is configured to be turned off when a first control signal is supplied from a first control line, and the third transistor is configured to be turned on when the first control signal is supplied from the first control line, and the third and fourth transistors have different conductivities.

7. The pixel as claimed in claim 6, wherein the third transistor is a NMOS-type transistor.

8. The pixel as claimed in claim 2, wherein the fourth transistor is configured to be turned off when a first control signal is supplied from a first control line and to be turned on when the first control signal is suspended, the third transistor is configured to be turned on when a scan signal is supplied to the scan line, and the first control signal is overlapping with the scan signal.

9. The pixel as claimed in claim 2, wherein the fourth transistor is configured to be turned off when the scan signal is supplied to the scan line, and the third transistor is configured to be turned on when the scan signal is supplied to the scan lines, and the third and fourth transistors have different conductivities.

10. The pixel as claimed in claim 1, wherein the voltage source is set to have a lower voltage value than the first power source.

11. The pixel as claimed in claim 1, wherein the voltage source is the first power source, an inverted voltage supplied through the scan line, or an inverted voltage supplied through a scan line of an adjacent pixel.

12. The pixel as claimed in claim 1, wherein a capacity of the feedback capacitor is configured to correspond to a material of the organic light emitting diode with respect to a color of light emitted from the organic light emitting diode.

13. The pixel as claimed in claim 1, further comprising a fifth transistor between the second transistor and the organic light emitting diode, the fifth transistor being configured to be turned off when at least the scan signal is supplied.

14. The pixel as claimed in claim 13, wherein the fifth transistor is configured to be turned off when a light emitting control signal is supplied to a light emitting control line, and configured to be turned on when the supply of the light emitting control signal is suspended.

15. The pixel as claimed in claim 14, wherein the light emitting control signal is overlapping with the scan signal.

16. An organic light emitting display device, comprising:

a plurality of pixels coupled to scan lines and data lines;

a scan driver configured to supply scan signals via the scan lines; and a data driver configured to drive the data lines, wherein each pixel of the plurality of pixels includes:

an organic light emitting diode between first and second power sources;

a first transistor coupled to a scan line and a data line, the first transistor being configured to receive a data signal via the data line when a scan signal is supplied to the scan line;

a storage capacitor configured to store voltage corresponding to the data signal received by the first transistor;

a second transistor coupled to the first transistor and configured to control an electric current from the first power source to the second power source via the organic light emitting diode with respect to the voltage stored in the storage capacitor; and a compensation unit configured to adjust voltage at a gate electrode of the second transistor, the voltage adjustment being sufficient to compensate for a deterioration degree of the organic light emitting diode, wherein the compensation unit includes:

a third transistor coupled to an anode electrode of the organic light emitting diode;

a fourth transistor between the third transistor and a voltage source, the voltage source having higher voltage than voltage at the anode electrode of the organic light emitting diode; and a feedback capacitor coupled between a gate electrode of the second transistor and a common node of the third and fourth transistors.

* * * * *